United States Patent [19]

Brooks

[11] 3,973,676

[45] Aug. 10, 1976

[54] CLOTH OR TOWEL RACK

[76] Inventor: Claude H. Brooks, 1416 Crestview Drive, Shelby, N.C. 28150

[22] Filed: Mar. 24, 1975

[21] Appl. No.: 561,330

[52] U.S. Cl. ..... 211/87

[51] Int. Cl.[2] ..... A47F 7/19

[58] Field of Search ..... 211/87, 30, 32, 33; 248/309 A, 206 R, 350; 223/24, 120

[56] References Cited

UNITED STATES PATENTS

| | | | |
|---|---|---|---|
| 639,050 | 12/1899 | Hurdel | 211/30 X |
| 1,013,539 | 1/1912 | Faerber | 211/33 X |
| 1,985,502 | 12/1934 | Isenberg | 248/206 R X |
| 1,993,399 | 3/1935 | Cohen | 211/33 |
| 2,025,437 | 12/1935 | Brown | 211/87 X |
| 2,502,714 | 4/1950 | Garnett | 248/206 R X |
| 2,663,530 | 12/1953 | Nye | 248/206 R |
| 2,707,564 | 5/1955 | Smith | 211/32 |
| 2,709,004 | 5/1955 | Dahlstrom | 211/33 X |
| 2,732,867 | 1/1956 | May et al. | 248/206 R X |
| 2,777,141 | 1/1957 | Nye | 248/206 R X |

FOREIGN PATENTS OR APPLICATIONS

| | | | |
|---|---|---|---|
| 1,359,918 | 3/1964 | France | 211/32 |

*Primary Examiner*—Roy D. Frazier
*Assistant Examiner*—Robert W. Gibson, Jr.
*Attorney, Agent, or Firm*—Jas. E. Britt

[57] ABSTRACT

This invention embodies the support arm of a bracket or the like provided with a cap formed as one half of a hollow sphere composed of flexible material such as rubber having a series of soft spinelike projections outstanding all over its outer surface to engage and hold cloths such as towels when casually tossed over or onto it.

The outwardly extending flexible fingers furnish a surface to which a cloth will cling but from which it may be removed freely even by a pulling action such as a child would give.

1 Claim, 3 Drawing Figures

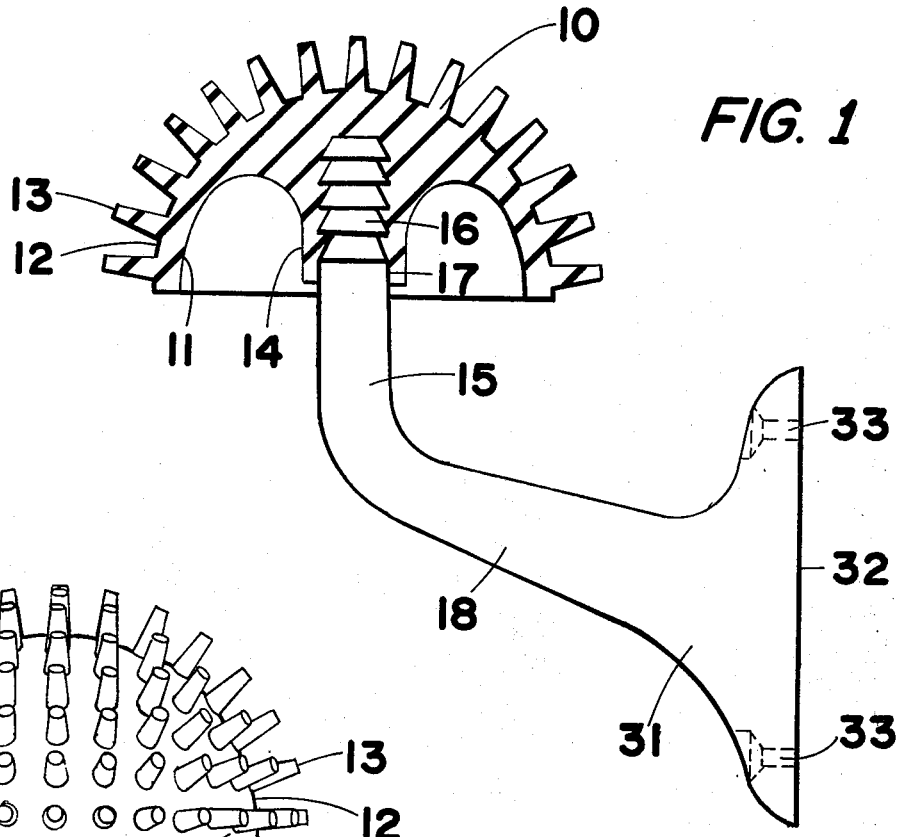
FIG. 1
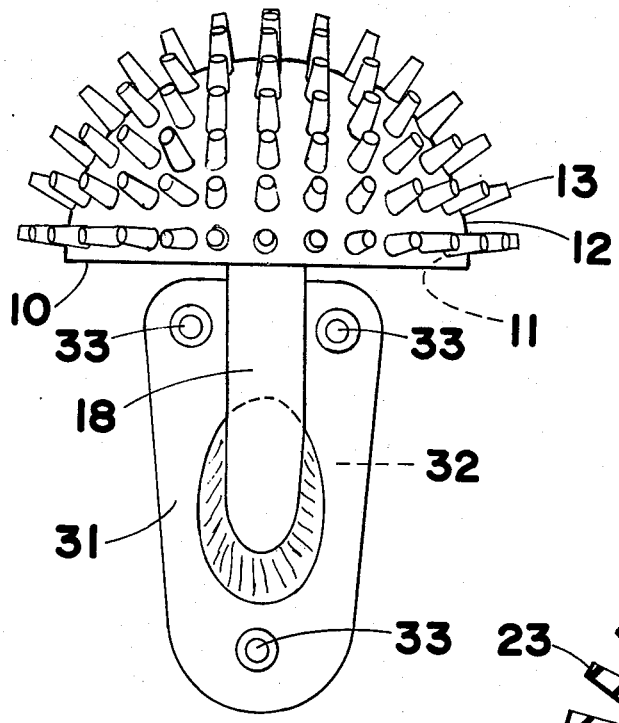
FIG. 3
FIG. 2
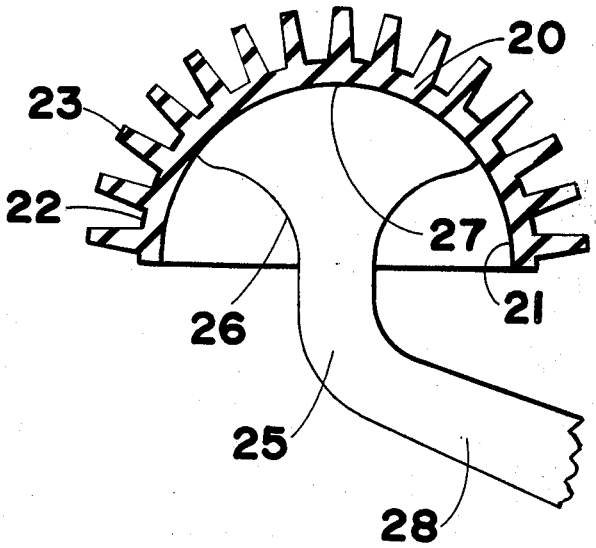

CLOTH OR TOWEL RACK

This invention relates to holders or racks for towels, wash cloths, scarfs or other cloth or like flexible fabrics materials upon which such materials may be kept for handy access between usings. It relates more particularly to the construction of the rack and its form or formation and mounting for the same.

Ordinarily a cloth or towel rack includes an upstanding arm portion terminating in an area over which a cloth may be hung or draped between usings.

In the prior art such arms have been capped with rubber or other soft material. But even then to hang a towel or other cloth or the like on the rack, it must be substantially balanced so a greater portion does not hang over in one direction.

However, I have found that by providing a new type of cap for the upstanding arm, the holder will keep a cloth or towel being casually tossed over the holder if any small portion comes to rest on the cap.

It is the object of this invention to construct a cloth or towel rack that will catch and hold a cloth, towel or other material, so tossed that any small portion falls over the cap of the rack.

Another object is to incorporate an arm formation for the cap which will withstand the withdrawal of the cloth, towel or other material without any effort to lift the cloth or towel from the cap, such as when a child might reach for the cloth or towel without regard to the type of rack on which it might be hanging.

Another object is to employ a material for the cap and also likewise for the arm which is readily available and easily worked for casting, moulding or otherwise processing for the various parts.

These and other objects will be apparent from the following description taken in connection with the accompanying drawings in which:

FIG. 1 is a view showing the arm from the side and the cap in section showing conical spinelike fingers projecting outwardly over the entire surface of the cap, FIG. 2 is a view similar to FIG. 1 showing an alternate mounting, and FIG. 3 is a front view showing the cap in full view, the spine fingers standing up all over the outer surface of the cap.

The principle part of the cloth or towel rack according to this invention consists of a hemispherical cap 10 of flexible material having an inner surface 11 in substantially spherical conformation and an outer spherical surface 12 which includes soft flexible conical spinelike fingers 13 outstanding over the entire surface 12. It has been found that a flexible cap with flexible conical spine fingers provides the maximum holding power for a rack of this type. The conical fingers 13 may have rounded tips so that they will not harm delicate fabrics such as some scarfs. It is very effective even when cloths are tossed on it without any special attention to the position of the cloth or fabrics or manner of its contact with the cap.

The inner surface 11 of cap 10 is formed with a depending sleeve portion 14 of the same material as the body. An upstanding arm 15 of a rigid plastic or other suitable material is provided with rings or grooves 16 in the terminal portion which fits into sleeve 14. The inner diameter 17 of the sleeve is such that the sleeve 14 must be forced onto the ringed portion 16 of the arm 15 to hold it in mounted position.

An alternate form is shown in FIG. 2. It comprises a cap 20 having an inner surface 21 which is spherical and an outer spherical surface 22 which includes soft flexible spinelike conical fingers 23, similar to fingers 13 in FIG. 1, which will function in the same manner.

In this form, the upstanding supporting arm 25 is provided with an enlarged upper end 26 terminating in a spherical surface 27 shaped to match the inner spherical surface 21 of cap 20. In this form cap 20 may be cemented or otherwise bonded to surface 27.

It will be observed that the mounting arrangements here shown will firmly secure the cap 10 or 20 to its mount 15 or 25 while permitting the overhanging or skirt portion to remain flexible or yieldable. This provides the most effective engagement of the spines with any cloth or like material. The overhanging skirt increases the extraordinary holding power which is inherent in a flexible spine covered cap.

The supporting arm 15 or 25 may consist of an extension 18 or 28 reaching out to form a base 31, shown only in FIG. 1, having a plate portion with a vertical face 32. The whole arm would then constitute a bracket suitable for mounting on a wall or like surface. This type of support bracket may be cemented to the wall surface or may be secured by suitable screws set into the wall surface through holes 33. The arm 18 or 28 may be modified to adapt it to being mounted otherwise than on a wall.

The arm 18 or 28 should be made of relatively stout rigid material such as a strong rigid plastic or a light metal such as aluminum or the so called white metal. It must be strong enough for a towel to be removed by pulling it off in any direction.

It will be apparent to those skilled in the art that a rack provided with the type of cap constructed according to the invention may be disposed for holding cloths in other ways than mounted upon a bracket or the like. For instance, it may be positioned on the top of a so called clothes tree where it could catch and hold scarves or other light wearing apparel.

It will be further apparent to those skilled in the art that many other forms and modifications may be made to embody this invention without departing from the spirit thereof and it is desired, therefore, that only such limitations shall be placed thereon as are imposed by the prior art or by the appended claims;

Therefore, what is claimed is:

1. A rack or holder for keeping cloths, towels, or other flexible or cloth-like materials, between uses, including a cap substantially in the form of one half of a hollow sphere over which articles may be draped, means for supporting the cap with its hollow portion facing downwardly, said cap being made of flexible material and having a spherical outer upwardly facing surface embodying radially outwardly extending slender (easily flexed) conical spines for contacting and holding said articles, said spines being elongated sufficiently to permit the same to be easily flexed laterally in any direction.

* * * * *